United States Patent [19]

Hivko

[11] 4,003,099

[45] Jan. 18, 1977

[54] BOAT HULL WITH GRAB RAILS ON ITS UNDERSIDE

[76] Inventor: Stephen Hivko, 1001 Hazelwood Ave., Middlesex, N.J. 08846

[22] Filed: Nov. 25, 1975

[21] Appl. No.: 635,145

[52] U.S. Cl. ..... 9/1.6; 9/3

[51] Int. Cl.[2] ..... B63B 17/00

[58] Field of Search ..... 9/1.1, 1.6, 1.7, 14, 9/11 R, 400; 114/123, 126, 66.5 F, 62

[56] References Cited

UNITED STATES PATENTS

| | | | |
|---|---|---|---|
| 980,790 | 1/1911 | Johnson | 9/3 |
| 1,383,551 | 7/1921 | Lowndes | 9/3 |
| 3,137,261 | 6/1964 | Noe | 114/62 |
| 3,587,123 | 6/1971 | O'Boyle | 9/1 C |

FOREIGN PATENTS OR APPLICATIONS

| | | | |
|---|---|---|---|
| 508,284 | 12/1954 | Canada | 9/1.6 |

*Primary Examiner*—Trygve M. Blix
*Assistant Examiner*—Stuart M. Goldstein

[57] ABSTRACT

A pair of grab rails on an underside of a boat hull is disclosed, so that in case the boat hull is capsized, persons may hold onto the rails, so as not to be carried away by wind and waves. The rails also aid in rolling over and righting the boat. The grab rails are sidewardly slideable from longitudinally extended runners formed on the hull bottom.

2 Claims, 4 Drawing Figures

BOAT HULL WITH GRAB RAILS ON ITS UNDERSIDE

This invention relates to safety devices, and more particularly to a safety device for boats.

It is therefore the principal object of this invention to provide a safety device for boats which will enable the occupants of a capsized boat, to be able to easily cling to the hull until help arrives.

Another object of this invention is to provide a safety device for boats, which will save lives, by providing the occupants of a capsized boat something to hold on to. Prior boat hull designs fail to provide adequate hull structure which allows such occupants to hold on in the event a boat capsizes. The present invention serves to eliminate this problem.

A further object of this invention is to provide a safety device of the type described, which may be made in kit form so as to be adaptable to old boats as well as new boats.

A still further object of this invention is to provide a safety device for boats, which may also be formed with plastic boat hulls.

Other objects of the invention are to provide a safety device for boats, which is simple in design, inexpensive to manufacture, rugged in construction, easy to use and efficient in use.

These and other objects will be readily evident upon a study of the following specification and the accompanying drawings, wherein.

Figure 1:
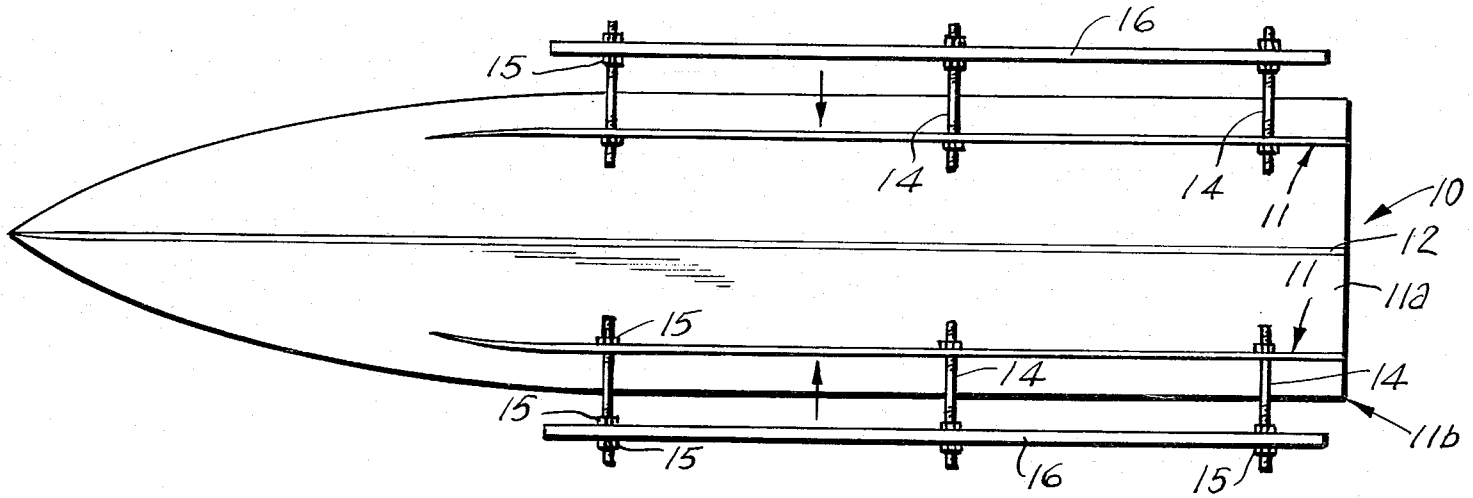
FIG. 1 is a bottom plan view of a boat comprising the present invention.
Figure 2:
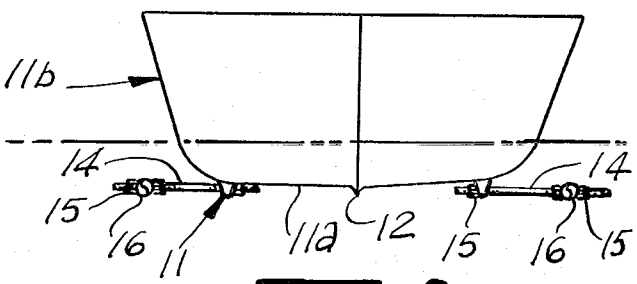
FIG. 2 is a diagrammatic rear view of FIG. 1.
Figure 3:
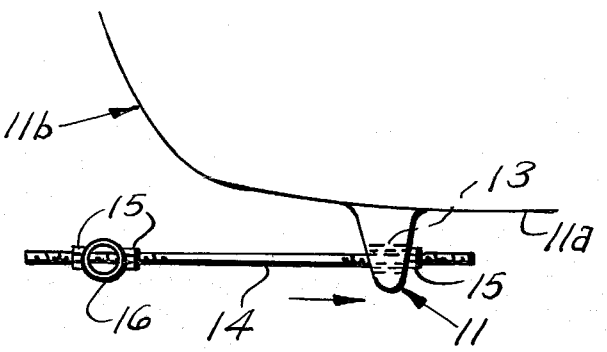
FIG. 3 is an enlarged fragmentary view of FIG. 2.

According to this invention, a safety device 10 consists of a pair of elongated runners 11 which are fixedly secured, one each, away from the keel 12 on the bottom 11*a* of boat hull 11*b*. A plurality of spaced apart plastic sleeves 13 are fixedly secured within the runners 11 for slideably receiving, one each, a threaded rod 14.

The rods 14 are rendered secure within the sleeves 13 by nut fasteners 15.

The rods 14 on each of the runners 11, are received transversely through an elongated tube 16 and the tubes 16 are secured stationary to rods 14, by means of a pair of nut fasteners 15 and lock-washers (not shown).

In the event the hull 11*b*, capsizes, the occupants will easily be able to grasp the tubes 16 which serve as handle grip means for the occupants, until help arrives. If the hull 11*b*, capsizes, the tubes 16, serving as handle grips, will extend away from the hull 11*b*, by being slideable within the sleeves 13.

Figure 4:
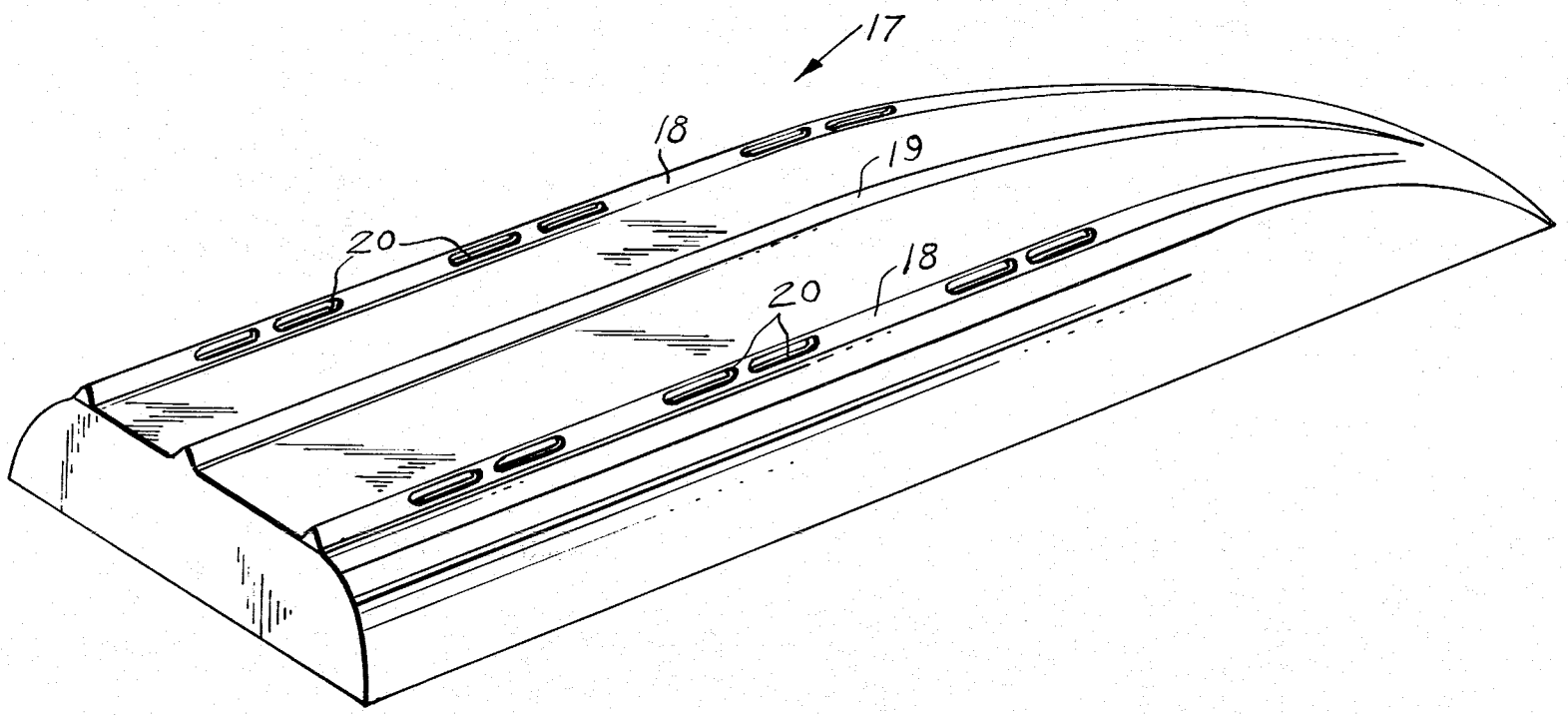
FIG. 4 is a perspective view showing a modified form of the invention.

Referring now to FIG. 4 of the drawings, a plastic hull 17 is shown to have a pair of runners 18, each being spaced away from the keel 19, all of which are molded integral with and extending from hull 17. The runners 18 of hull 17 are provided with spaced apart and elongated openings 20 therethrough which provides handle grip means for the boat occupants if the boat capsizes.

It shall be noted that the heretofore described structures, will not impair a boat's aquadynamics within the water.

What I now claim is:

1. A safety device for a boat, comprising in combination, a pair of parallel, longitudinally running spaced apart tubes which serve as grab rails for the occupants of a capsized boat, a pair of longitudinally extending runners formed on the underside of the hull of said boat, one tube and one runner being located on each side of the keel of the boat hull, a plurality of parallel, spaced apart rods being threaded at each end, the rods extending through said tubes and being slideably supported in transverse openings through said runners, each rod being secured to a runner by means of a nut fastener threadably attached to one end of the rod and in abutting relationship with the runner to prevent disengagement of the rod from the runner, each rod being secured to a tube by means of nut fasteners, one abutting each side of the tube, and being threadably attached to the other end of the rod.

2. The combination as set forth in claim 1, wherein each transverse opening of said runners is fitted with a plastic sleeve, said rods being slideable in said sleeves.

* * * * *